US007143569B2

(12) United States Patent
Limousin

(10) Patent No.: US 7,143,569 B2
(45) Date of Patent: Dec. 5, 2006

(54) CALIBRATED SHRINK WRAP PACKAGING SYSTEM AND ASSOCIATED METHOD

(75) Inventor: Jean-Louis Limousin, Louisville, KY (US)

(73) Assignees: Lantech Management Corp., Louisville, KY (US); Lantech HOlding Corp., Louisville, KY (US)

( * ) Notice: Subject to any disclaimer, the term of this patent is extended or adjusted under 35 U.S.C. 154(b) by 165 days.

(21) Appl. No.: 10/970,538

(22) Filed: Oct. 21, 2004

(65) Prior Publication Data

US 2006/0086067 A1 Apr. 27, 2006

(51) Int. Cl.
*B65B 9/06* (2006.01)

(52) U.S. Cl. ..... 53/550; 53/568; 53/389.4; 53/64; 53/507; 493/476; 493/478

(58) Field of Classification Search ..... 53/64, 53/389.4, 550, 568; 493/476, 478, 479
See application file for complete search history.

(56) References Cited

U.S. PATENT DOCUMENTS

| | | | | |
|---|---|---|---|---|
| 3,494,096 | A | 2/1970 | Suzuki | |
| 3,583,888 | A | 6/1971 | Shanklin | |
| 3,595,456 | A | 7/1971 | Rosenthal | |
| 3,732,789 | A | 5/1973 | Hartleib | |
| 3,800,499 | A | 4/1974 | Feldman | |
| 4,035,983 | A | 7/1977 | Shanklin et al. | |
| RE30,010 | E | 5/1979 | Shanklin | |
| 4,185,443 | A | 1/1980 | Budzyn | |
| 4,219,988 | A | 9/1980 | Shanklin et al. | |
| 4,325,519 | A | 4/1982 | McLean | |
| 4,339,093 | A | 7/1982 | Shanklin et al. | |
| 4,519,185 | A | 5/1985 | Horn et al. | |
| 4,649,693 | A | 3/1987 | Yeager | |
| 4,936,079 | A | 6/1990 | Skalsky et al. | |
| 5,134,835 | A | 8/1992 | Walkiewicz, Jr. et al. | |
| 5,152,738 | A | 10/1992 | Zehender | |
| 5,165,221 | A | 11/1992 | Udelson et al. | |
| 5,235,792 | A | 8/1993 | Hanagata | |
| 5,381,640 | A | 1/1995 | Chiu | |
| 5,603,202 | A | 2/1997 | Hanagata | |
| 5,653,085 | A * | 8/1997 | Suga | 53/75 |
| 5,956,931 | A | 9/1999 | Stork | |
| 6,044,615 | A | 4/2000 | Fukuda | |
| 6,817,163 | B1 | 11/2004 | Limousin | |
| 6,912,830 | B1 * | 7/2005 | Limousin | 53/459 |
| 6,962,033 | B1 * | 11/2005 | Guzman | 53/55 |

* cited by examiner

*Primary Examiner*—Stephen F. Gerrity
*Assistant Examiner*—Hemant M. Desai
(74) *Attorney, Agent, or Firm*—Wood, Herron & Evans, LLP

(57) ABSTRACT

An automatic high-speed wrapping system for wrapping packages in heat sealable thermoplastic film includes a film delivery unit wherein the film is dispensed and wrapped around the packages at a high rate of speed as the packages travel through the system. The packages travel continuously in a straight line through the system and are delivered at the input end of the system by a feed conveyor into a wrapping station where the packages are surrounded by the film, thence to the side sealing mechanism which forms a seal while severing the salvage from the packages, then into an end sealing mechanism where both ends of the packages are sealed and the film web connecting succeeding packages is severed. The system has a variety of components which are adjustable to efficiently accommodate a variety of product dimensions. The spacings of the various components are represented one calibrated scales for efficient and accurate set up and operation of the system.

21 Claims, 4 Drawing Sheets

CALIBRATED SHRINK WRAP PACKAGING SYSTEM AND ASSOCIATED METHOD

BACKGROUND OF THE INVENTION

This invention relates generally to the art of film wrapping systems for use in wrapping objects with shrink wrap film and, more particularly, to improvements directed to preparing the film wrapping system for wrapping products of differing dimensions.

A wide variety of systems are known for wrapping packages in thermoplastic film. Some of these machines are known as L-sealers because they form "trim seals" utilizing a web of center folded film. More recent machines utilize a continuous longitudinal sealer and a cross sealer which moves at approximately the velocity of the packages as they travel through the machine so that the packages are not stopped while the machine performs the end sealing operation. One example of a shrink wrap packaging system is disclosed in U.S. patent application Ser. No. 10/286,523, filed Nov. 1, 2002, assigned to the Assignee of this invention and hereby incorporated by reference in its entirety.

Most known shrink wrap packaging systems utilize film which is provided on a roll in two plies with each ply being joined together by a longitudinal fold line. The two-ply film is dispensed from a supply roll and delivered to a wrapping station of the shrink wrap packaging system. The film is commonly inverted and reoriented to provide an opening for convenient access and entry of the products between the dual plies of the film. The film is reoriented in many shrink wrap packaging systems by an upper and a lower film inverting rod or plow system. The upper and lower film inverting rods are positioned above and below, respectively, a feed conveyor which is advancing the products to be wrapped.

Shrink wrap packaging systems of these types process and wrap a variety of different products. Commonly, such products are of differing shapes, sizes and dimensions. For example, shrink wrap packaging systems may process and wrap a single compact disc (CD) package which is very thin and other consumer retail items which have a significantly greater height and a larger width dimension. One problem associated with many known shrink wrap packaging systems is the difficulty in efficiently processing and wrapping a wide variety of packages and products, especially those having distinctly different dimensions, heights and widths.

Recent advancements in the art of shrink wrap packaging systems have included adjustable film inverter rods in which a spacing between the rods is adjustable to accommodate a variety of differing height products being wrapped. The film inverter rods are only one of many pairs of components in typical film wrapping systems which must be adjusted depending upon the dimensions of the product being wrapped. Moreover, the spacing between the various pairs of associated components of the shrink wrap packaging systems is not always the same as the product dimension. For example, while the spacing between the film inverter rods is roughly equal to the height of the product being wrapped, the position of a side seal mechanism for joining the free edges of the shrink wrap film and enclosing the product is roughly half the height of the product. Generally, the side seal should be located approximately at the equator of the product and the side seal mechanism should be centered at that location above the platform or conveyor supporting the product.

Many other components of the shrink wrap packaging system likewise must be adjusted and appropriately positioned for a given product and associated product dimensions. In one shrink wrap packaging system commercially available from the assignee of this invention, five different height adjustments and three different width adjustments must be made to the system to properly set it up for wrapping a given product. An operator of a shrink wrap packaging system typically must initially measure the product and perform the required calculations to determine the spacing between each of the eight or so pairs of components required for proper wrapping of the product. The set up procedure for the shrink wrap packaging system requiring these operations can take anywhere from eight to 19 or more minutes. This has proven to be an inefficient and often troublesome procedure minimizing the productivity of the shrink wrap packaging system, wasting time and materials and providing poor packaging results if not completed accurately and correctly.

Therefore, a need exists in the shrink wrap packaging industry for a packaging system which can readily accommodate a wide variety of product configurations, heights and widths without the above-described problems associated with known shrink wrap packaging systems, set up operations and procedures.

SUMMARY OF THE INVENTION

These and other objectives have been achieved with this invention, which in one embodiment is a shrink wrap packaging system with calibrated scales for efficient and accurate set up and operation of the system. The film wrapping system according to one embodiment of this invention includes a number of stations or sub-systems for wrapping products of differing dimensions in film. The film wrapping system includes a feed conveyor to deliver a series of products to a wrapping station. The wrapping station includes a pair of film inverter rods and an adjustment mechanism for changing the spacing from one another to correspond to the height of the product being wrapped. A film delivery unit dispenses a supply of film in a direction generally perpendicular to the feed direction of the products. The film is inverted by the inverter rods at the wrapping station where the products are inserted between the plies of the film.

The system also includes in one embodiment a film delivery unit adjustment mechanism to adjust a position of the film delivery unit and the film being delivered to the wrapping station as a function of the spacing between the film inverter rods and, consequently, the height of the product being wrapped. The film delivery unit adjustment mechanism is described in more detail in the aforementioned U.S. patent application Ser. No. 10/286,523 filed Nov. 1, 2002, assigned to the assignee of this invention and hereby incorporated by reference in its entirety.

Additionally, the system in one embodiment includes an adjustable roller positioned between the film delivery unit and the wrapping station to deliver film to the wrapping station at a desired height relative to the position of the film inverter rods and the height of the product being wrapped. A side seal mechanism and an end seal mechanism are each located downstream in the feed direction from the wrapping station to join the first and second plies together and enclose each of the products in individually wrapped packages. A heat shrink tunnel in one embodiment is located downstream from the sealing mechanisms to heat the film and thereby shrink it around the product.

The various components of this system which require adjustment based upon a height, width or other dimension of the product being wrapped each include a display or scale which indicates a spacing between the associated components. Adjustment mechanisms are available for an operator to positionally adjust the various components relative to the complementary component.

One important advantage of this invention is that the various scales and displays are calibrated so that the operator more efficiently and effectively adjusts the position of the various components for a given product dimension. For example, a product having a three inch height might require the operator to positionally adjust the various height components relative to each other for appropriate wrapping so that each scale displays a "3" even though specific pairs of components represented by one or more of the scales do not actually have a three inch spacing there between. The machine components, adjustment mechanisms and associated scales are calibrated so that for a given product dimension each scale is to be set at the same number for the entire shrink wrap packaging system even though given components in the system may not have an actual spacing of that value. As a result, an operator of the system simply sets each adjustment mechanism so that the associated scale reads the same number as the other scales thereby avoiding the need for complicated calculations and other decisions associated with properly setting up known shrink wrap packaging systems.

Generally, this invention is a film wrapping system in which the relative positions of a first pair of adjustably spaced components are adjusted by a first adjustment mechanism adapted to selectively change the spacing of the first pair of components. A first scale indicates the spacing of the first pair of components and the indicated spacing is correlated to a product dimension in a first manner. Moreover, the wrapping system includes a second pair of adjustably spaced components in which their relative positions are changed by a second adjustment mechanism and a second scale indicates the spacing of the second pair of components. The indicated spacing of the second pair of components is correlated to the product dimension in a second manner different than the first manner. The first and second scales are adapted to the manners of correlation such that differences in the spacing of the first pair of components and the spacing of the second pair of components for the product dimension result in the indicated spacing from the first and second scales being substantially the same.

As a result of the film wrapping system and associated method according to this invention, a variety of product configurations, heights and widths can be conveniently and efficiently accommodated with adjusting the spacing between the various components of the system while avoiding the associated problems and disadvantages of shrink wrap packaging systems in the prior art.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
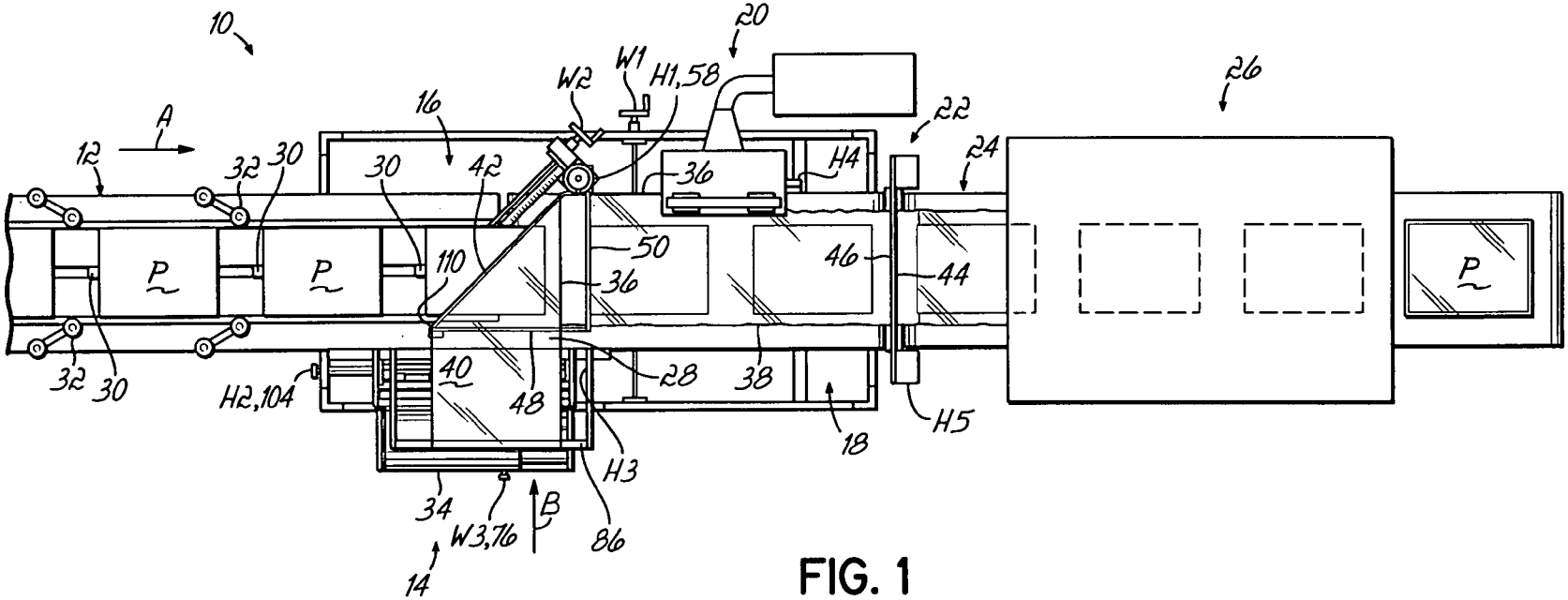
FIG. 1 is a top view of a film wrapping system according to one embodiment of this invention.
Figure 1A:
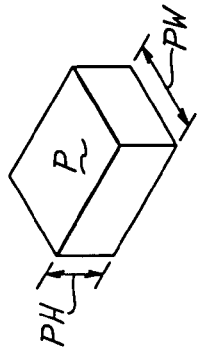
FIG. 1A is a perspective view of an exemplary product to be wrapped in the system of FIG. 1.

Referring now to FIG. 1, a top view of an exemplary automatic high-speed film packaging system 10 according to one embodiment of this invention is shown. The system 10 generally includes a feed conveyor 12, a film delivery unit 14, a wrapping station 16, an intermediate conveyor 18, a side sealer 20, an end sealer 22, a downstream conveyor 24 and a heat shrink tunnel 26. Products P to be wrapped in film 28 enter the system 10 via the feed conveyor 12. The feed conveyor of FIG. 1 includes a number of spaced flight lugs 30 which move continuously in the feed direction to advance the products P. The products P are centered laterally on the feed conveyor 12 by a pair of spaced, adjustable guides 32.

The conveyor 12 delivers the spaced-apart and aligned products P to the wrapping station 16 where a folded film 28 from a film roll 34 in the film delivery unit 14 surrounds each product P. The folded film 28 enveloping each product P is sealed at its free edges 36, 36 by the side sealer 20 to form a tube of film 28 enclosing the spaced products P. The film 28 between the adjacent products P is sealed and severed at the end sealer 22 to produce individual sealed packages of the product P.

The system 10 wraps a product P in a flexible plastic film 28 in which the travel of the product P is essentially continuous through the system 10 in a feed direction indicated by arrow A. The film 28 may be any one of a variety of films well known in the art (i.e., commercial grade polyolefin, PVC, LDPE, etc.) and is supplied to the system 10 as a folded web in the direction of arrow B and at right angles to the feed direction of the product P (shown in FIGS. 1 and 2). The film 28 is folded about a longitudinal fold 38 thereby forming upper and lower plies 40, 40 in which each ply has a free edge 36 opposite from the fold line 38. Commonly, the two-ply folded film 28 is provided on the supply roll 34. Alternatively, single ply film may be provided on a supply roll and subsequently folded into the described two-ply configuration as is well known in the art. The film 28 is provided to upper and lower inverter rods 42, 42 of the wrapping station 16 where the film 28 is redirected and turned inside out to travel in the feed direction with the products P delivered by the feed conveyor 12.

The feed conveyor 12 pushes products P into the wrapping station 16 to cause them to be enclosed by the folded film 28 supplied by film delivery unit 14 on the top, bottom, and one side of the product P with the other side of the product P adjacent to the free edges 36, 36 of the folded film 28 being open initially. The product P thus enclosed in the web of film 28 travels on the intermediate conveyor 18 with the film 28 past the side sealing mechanism 20 in FIG. 1 which seals the two free edges 36, 36 of the folded film 28 together to form a continuous tube of film which envelops the succession of products P which are being fed into the system 10. The side sealer 20 also severs the excess width of film 28 from the tube and this salvage (not shown) is removed by a salvage accumulator (not shown), such as a vacuum or other take-up mechanism.

As the product P progresses further through the system 10, the end sealing mechanism 22 seals the trailing edge 44 of each package while simultaneously sealing the leading edge 46 of the succeeding package P in the system 10 and it also severs one package P from the other while the packages are traveling without stopping through the system 10. The end seal mechanism 22 is so designed that it travels a short distance with the product P at substantially the same velocity while the seals 44, 46 are being made. After the seals 44, 46 have been made, the sealing mechanism 22 releases from the film 28 and returns to its original position to repeat the transverse seals 44, 46 for the next products. The wrapped product P may then be conveyed on the downstream conveyor 24 through the shrink tunnel 26 for shrinking of the film 28 around the product P.

The system 10 shown and described herein is representative of a Lantech.com model SW-3000 Continuous Motion, Flighted Infeed, Side-Seal Shrink Wrapper. Additional details of the system 10 are found in U.S. patent application Ser. No. 10/286,523, filed Nov. 1, 2002 and hereby incorporated by reference. While exemplary embodiments of the system 10, and associated components, are shown and described herein to describe the invention, specific models or embodiments of the system or these components could readily be varied, deleted or changed as known by one of ordinary skill in this art without departing from the scope of this invention.

The system 10 is designed to accommodate a variety of product P heights, widths and dimensions. Accordingly, selected pairs of components are positionally adjustable relative to each other to properly wrap the film 28 around products P of different widths, heights or dimensions. Examples of such components will now be described.

Figure 2:
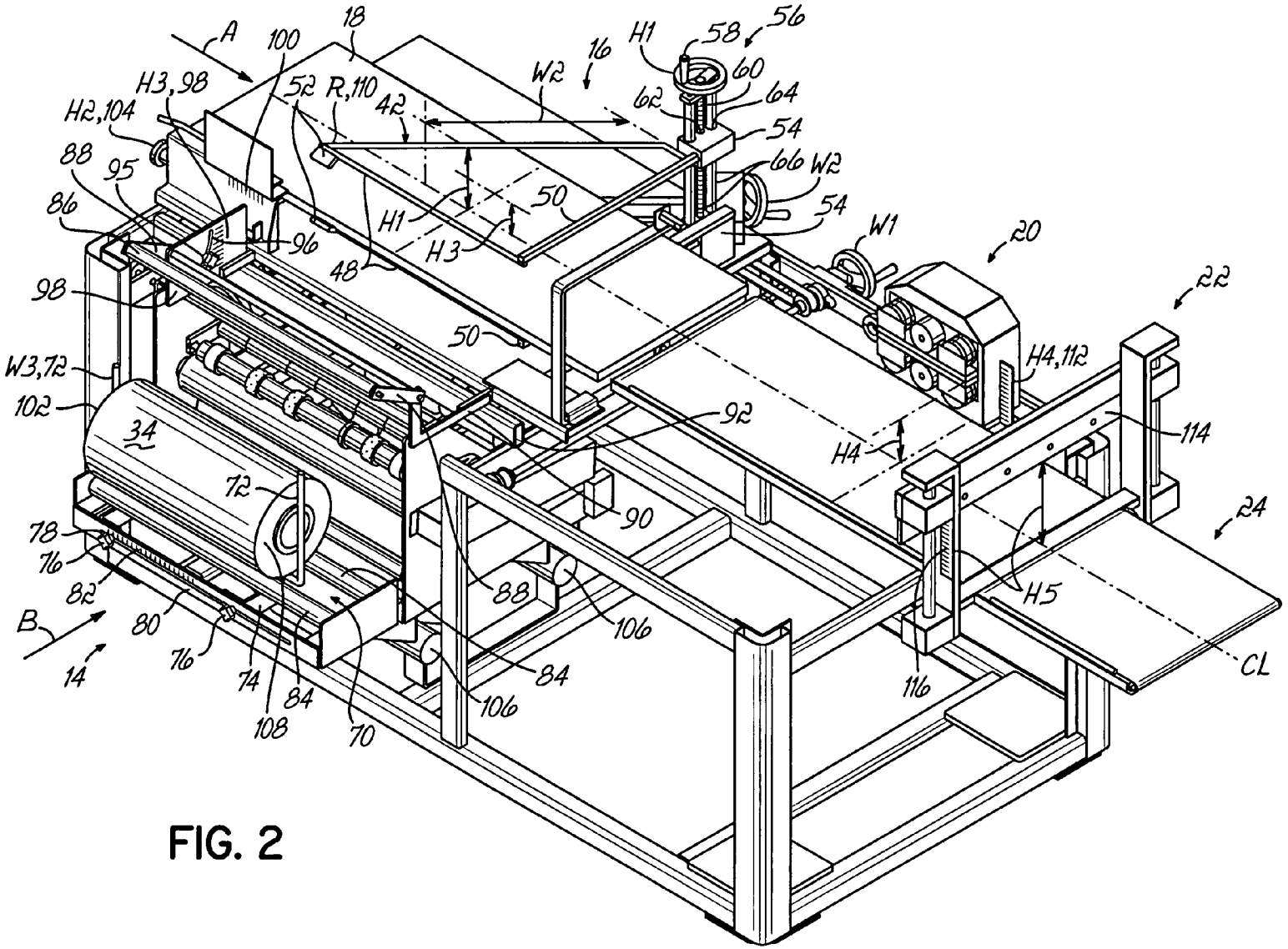
FIG. 2 is a perspective view of a film delivery unit and a product wrapping station as well as other portions of the system of FIG. 1.

As shown particularly in FIGS. 1 and 2, the two-ply film 28 is delivered from the supply roll 34 by the film delivery unit 14 in a direction indicated by arrow B generally perpendicular to the feed direction (arrow A) of the products P. As the film 28 enters the wrapping station 16, each ply 40 is guided around one of the film inverter rods 42 and thereby redirected approximately 90° to travel in the feed direction of arrow A. The film inverter rods 42 are oriented approximately 45° with respect to the feed direction. In addition to being redirected, the film 28 is inverted by the film inverter rods 42 such that confronting inner first faces of the film 28 provided by the film delivery unit 14 are inverted so that previously outer second faces of the plies 40 of the film 28 are juxtaposed to each other and around the product P downstream from the film inverter rods 42.

As shown particularly in FIG. 2, each film inverter rod 42 is joined to a pair of mounting rods 48, 50 to form a generally triangular configuration. Mounting rod 48 is oriented generally parallel to the feed direction; whereas, mounting rod 50 is oriented generally perpendicular to the feed direction. An inclined guide tab 52 is mounted proximate the intersection of each film inverter rod 42 and the associated mounting rod 48.

Each film inverter rod 42 and the associated mounting rods 48, 50 are mounted to a hub 54, respectively. The hub 54 for the lower film inverter rod 42 is fixed beneath the conveyor 18. The hub 54 for the upper film inverter rod 42 is mounted on a film inverter rod adjustment mechanism 56 to adjust a spacing H1 between the upper and lower film inverter rods 42 in a direction generally perpendicular to the feed direction (i.e., vertically) to accommodate products P of differing heights. The film inverter rod adjustment mechanism 56 in one embodiment includes an operator hand wheel 58 mounted atop a threaded rod 60 to rotate the rod 60. The hub 54 includes a threaded aperture 62 engaged with the threaded rod 60 as well as two additional apertures 64, 64 through which guide rods 66, 66 project. In operation of the system 10, the operator rotates the hand wheel 58 in the appropriate direction to raise or lower the upper film inverter rod 42 so that the upper ply 40 of the film 28 is positioned slightly above the top upper surface of the product P being wrapped. The adjustment mechanism includes a scale 68 and the spacing H1 between the film inverter rods 42 is displayed by a pointer 68*a* on scale of FIG. 3.

The film delivery unit 14, as shown generally in FIGS. 1–2, is mounted adjacent to the wrapping station 16 in a direction generally perpendicular to the feed direction. The film delivery unit 14 supplies film 28 from the supply roll 34 to the wrapping station 16. The supply roll 34 is supported by a cradle assembly 70 of the film delivery unit 14. The supply roll 34 is positioned atop the cradle assembly 70 and between a pair of film roll retainer posts 72, 72. In one embodiment, the downstream film roll retainer post 72 is joined to a bracket 74 that is secured by a set screw 76 in a slot 78 of front frame member 80 in the cradle assembly 70. To adjust the spacing between the film roll retainer posts 72, 72 for different width supply rolls 34, the operator would loosen the set screw 76 and slide the bracket 74 and associated film roll retainer post 72 along the slot 78 to the appropriate position to capture the supply roll 34 between the film roll retainer post 72. The spacing W3 between the posts 72, 72 is displayed on scale 82 of FIG. 4 by set screw 76. The spacing W3 is a geometry correction for different width products P in certain embodiments of this invention.

Referring to FIG. 2, the path of the film 28 from the supply roll 34 through the delivery unit 14 and to the wrapping station 16 is shown. The supply roll 34 rotates on a pair of cradle rollers 84, 84 and the film 28 is fed around a series of rollers toward a film delivery height adjustment roller 86 positioned between the film delivery unit 14 and the wrapping station 16. The roller 86 is mounted between a pair of arms 88, 88 which are coupled to corresponding links 90 mounted to the frame 92 of the system 10. Advantageously, the position of the arms 88 and subsequently the height H3 of the roller 86 relative to the upper surface of the feed conveyor 12 is adjustable to deliver the film 28 to the wrapping station 16 at an appropriate height H3 relative to the position of the film inverter rods 42. Preferably, the height H3 of the roller 86 is equal distance between the upper and lower film inverter rods 42. Since the spacing H1 between the film inverter rods 42 is adjustable, the height H3 of the film delivery roller 86 is likewise adjustable to provide for proper positioning relative to the film inverter rods 42. Generally, the spacing H1 of the film inverter rods 42 is about twice the height H3 of the roller 86 above the feed conveyor 12 surface.

The arm 88 supporting the roller 86 includes a set screw 94 which is captured within an arcuate slot 96 in a scale plate 98. Adjustment of the roller 86 height is accomplished by the operator loosening the set screw 94 and pivoting the arms 88 coupled to the roller 86 upwardly or downwardly as desired and then resecuring the set screw 94 with the roller 86 in the appropriate position approximately midway between the upper and lower film inverter rods 42. As the film 28 passes around the roller 86, the two plies 40 are separated and guided by the respective film inverter rod 42 to surround the product P on the conveyor 12. The height H3 is displayed on scale 98 by pointer 98*a* of FIG. 3.

As the spacing H1 between the upper and lower film inverter rods 42 is adjusted to accommodate different height products P, movement of the film delivery unit 14 in a direction generally parallel to the feed direction is required to maintain proper film delivery geometry. Spacing H2 is displayed on scale 100 of FIG. 3 by pointer 100*a* and is indicative of the position of the film delivery unit 14 relative to the wrapping station 16. For products P which are extremely thin and having little or no height such as a CD lying generally flat on the feed conveyor 12, a reference point R at the intersection of the film inverter rods 42 and the mounting rod 50 is generally aligned with the upstream edge 102 of the supply roll 34 on the film delivery unit 14. However, the film delivery unit 14 must be moved in a direction generally parallel to the feed direction as the spacing H1 between the film inverter rods 42 is adjusted to accommodate different height products P.

In operation, the spacing H1 between the film inverter rods 42 is adjusted to accommodate the product P height. Once the film inverter rods 42 are so adjusted, the position H3 of the film delivery height adjustment roller 86 is likewise set by the operator to be approximately equal distance between the film inverter rods 42. The position H2 of the film delivery unit 14 is then adjusted relative to the film inverter rods 42 to provide for proper alignment, geometry and delivery of the film 28 to the wrapping station 16. According to one embodiment of this invention, the film delivery unit 14 is moved via the adjustment knob 104 along the rails 106 one-half inch to adjust for each inch in package P height to establish the correct film delivery geometry. The film inverter rods 42 at the wrapping station 16 should remain stationary as the film delivery unit 14 position is adjusted. For each inch increase in product P height, the position H2 of the film delivery unit 14 is adjusted one-half inch in the upstream direction. Conversely, for each inch decrease in product P height or spacing between the film inverter rods 42 a half-inch movement of the film delivery unit 14 in the downstream feed direction is required for correct film geometry.

As previously described, the position of the film roll 34 in relation to the film inverter rods 42 must be adjusted depending on the product P height. Preferably, the downstream edge 108 of the film roll 34 must be aligned with the film 28 position on the inverting rods 42. H2 represents the offset of the position of the film roll 34 relative to the film inverting rods 42. If a product P has a theoretical height dimension of zero, the upstream edge 102 of the film roll 34 will align with the apex 110 of the film inverting rods 42 and the downstream edge 108 of the film 28 is by default aligned. When the product P height changes, for example to four inches, the opening movement of the film inverter rods 42 pulls two inches from the top ply 40 of the film 28 and two inches from the bottom ply 40 of the film 28. As a result, the right side edge of the inverting rods 42 is no longer in alignment and is offset by two inches. The H2 height adjustment allows the operator to move the film roll 34 in its cradle 70 two inches to the left or upstream in the product flow direction so that the downstream edge 108 of the film roll 34 is properly aligned relative to the film inverter rod 42 position based upon the product P height dimension. The position of the film delivery unit 14 is indicated by the scale 100 and pointer 100*a* in FIG. 3.

In addition to the spacing H1 between the film inverter rods 42 and the height H3 of the roller 86 delivering the film 28 to the wrapping station 16, a variety of other spacings of various components of the system 10 must be adjusted depending on the product P dimensions. H4 is a height of the side sealer 20 relative to the upper surface of the conveyor 24. Preferably, H4 is approximately half the product P height dimension so that the side seal is located at approximately the equator of the wrapped product. The position of the side sealer is represented on scale 112 by pointer 112*a*. The final height adjustment shown in FIGS. 1–2 is H5 which is the seal bar jaw 114 opening for the end sealer 22 and is represented by scale 116 in FIG. 3 by pointer 116*a*. The spacing H5 of the seal bar 114 provides clearance for the product P exiting the side sealer 20 on the conveyor.

In addition to the adjustments for spacings H1–H5 required for product P height, adjustments for various components of the system 10 are required depending on the product P width dimension. For example, W1 represents an adjustment for the width of the product P to move the intermediate conveyor 18 relative to the center line CL of the system 10 and is shown on digital scale 118. W2 represents a width dimension adjustment for the inverting rod 42 width to adjust to the center line CL of the system 10 and is shown in scale 120 by pointer 102*a*. W3 represents an adjustment that applies to the Lantech Model SW-3000 which includes adjustment of the inverting rod 42 width adjustments which are made in 45° increments rather than parallel to the film roll 34 as in other shrink wrap film systems. When making adjustment in parallel mode, the apex 116 of the inverter rods 42 always stays in line with the film roll 34. For example, if the upstream left edge 102 of the film roll 34 is offset by one inch for a width of two inches, any width adjustment parallel (up to the maximum of 15 inches width) will keep the upstream left side edge 102 of the film roll 34 at the one inch marker. On the system 10 shown in FIGS. 1 and 2, the inverting rods 42 move at 45° and if the upstream edge 102 of the film roll 34 is offset by one inch for a width of two inches, the offset will increase as the width adjustment increases. Therefore, running two different width products P of the same height requires correction to the position of the upstream edge 102 of the film roll 34 and that adjustment is independent of the adjustment required for the H2. The proportion of the W3 scale 82 shown in FIG. 4 is made by running the inverting rod 42 width from zero to a maximum of 15 inches dividing it into equal increments.

Figure 3:
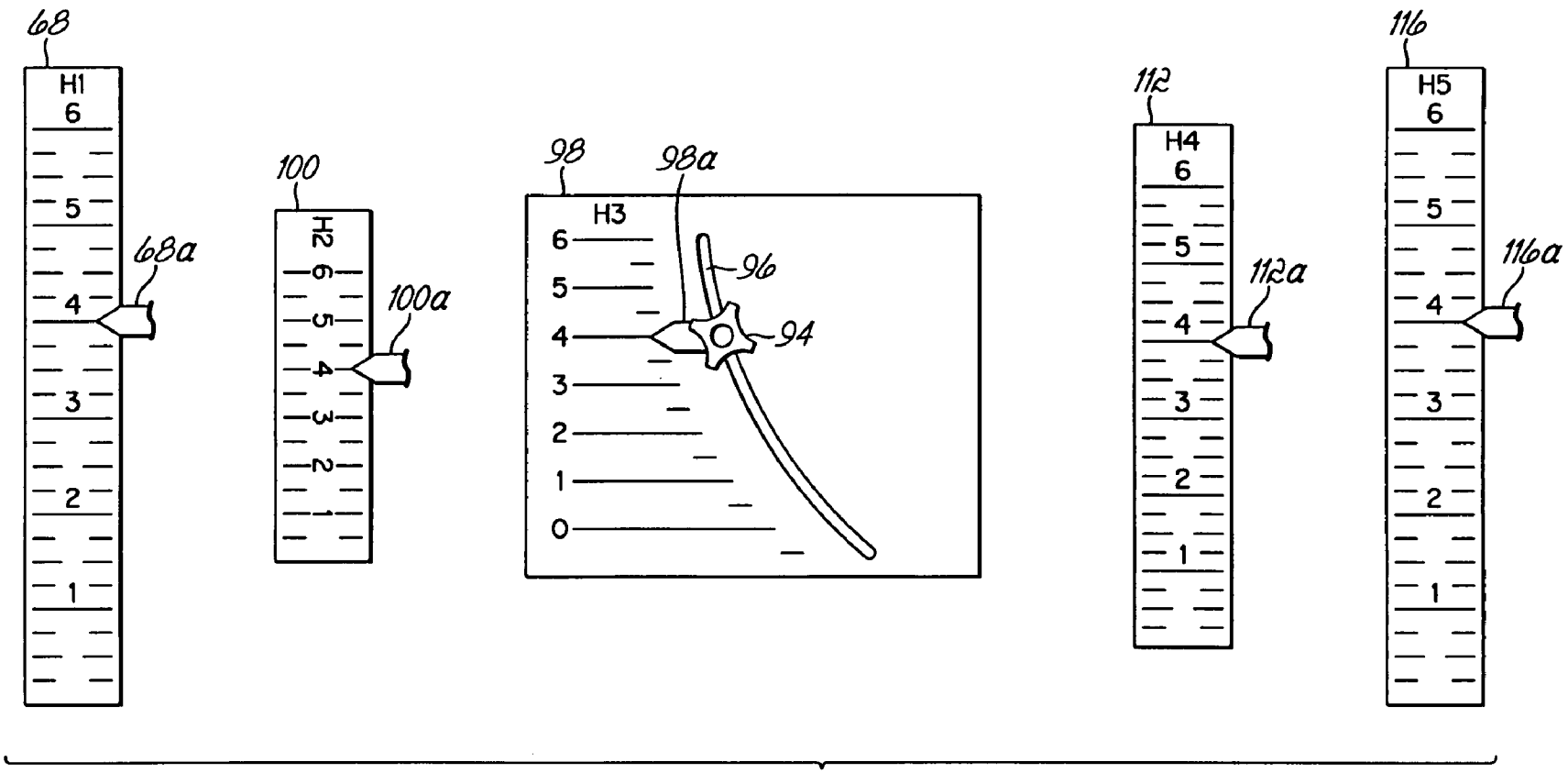
FIG. 3 is a view of exemplary calibrated scales to display spacings between associated components related to a height dimension of the product being wrapped in the system of FIG. 1.
Figure 4:
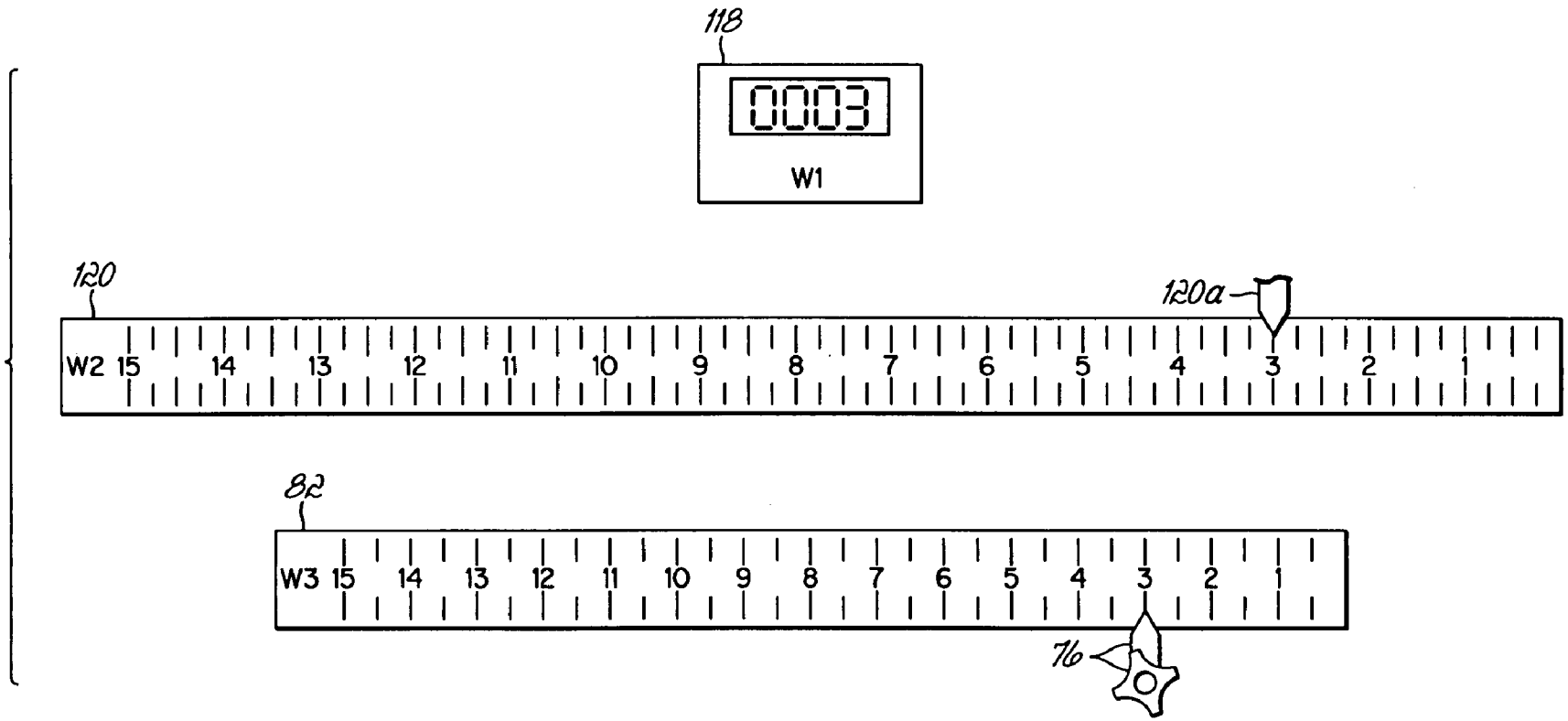
FIG. 4 is a view similar to FIG. 3 of exemplary calibrated scales to display a width dimension of the product to be wrapped.

Referring to FIGS. 3 and 4, on various scales 68, 100, 98, 112, 116 for H1 through H5, respectively, and scales 118, 120, 82 for W1 through W3, respectively, representing the spacing of the associated components previously described are shown. The scales 68, 100, 98, 112, 116 for H1 through H5 and scales 120, 82 for W2 through W3 are analog scales and each include a pointer in one form or another to indicate a spacing of the associated components. Scale 118 for W1 includes a digital display to indicate the associated spacing. An important feature of this invention is that for a product P dimension, height, width or otherwise, the associated scales for H1 through H5 or for W1 through W3 will be set to the same numbers even though the spacings for the components associated with that scale may not be equal.

For example, for a product P height of approximately four inches, the spacing H1 of the inverter rods 42 is roughly four inches and the scale 68 will indicate four. However, the scale 98 for spacing H3 will likewise indicate four as will the scales 100, 112, 116 for H2, H4 and H5 even though the spacing between the components associated with H2 through H5 may not be four inches. In fact, the spacing for the components associated with H3, the roller 86 and the supper surface of the conveyor 12, will be roughly two inches even though the associated scale 98 reads four. Having all of the H1 though H5 scales reading the same value for a given product P height greatly simplifies the operator's time and effort in setting up the system 10 for wrapping a given product P. In fact, it has been estimated that the set-up time for the system 10 is reduced from eight to 19 minutes in prior art machines down to two minutes with systems according to this invention, even for new users of the system.

While the various adjustment mechanisms to position various components of the system 10 are shown and described herein as being manual and independent from each other, alternative embodiments of this invention include automatic adjustment of the positions.

From the above disclosure of the general principles of this invention and the preceding detailed description of at least one preferred embodiment, those skilled in the art will readily comprehend the various modifications to which this invention is susceptible. Therefore, we desire to be limited only by the scope of the following claims and equivalents thereof.

I claim:

1. A film wrapping system for wrapping products of differing dimensions in film, the system comprising:

a first pair of adjustably spaced components, a first adjustment mechanism adapted to selectively change the spacing of the first pair of components, and a first scale indicating the spacing of the first pair of components, the indicated spacing being correlated to a product dimension in a first manner; and a second pair of adjustably spaced components, a second adjustment mechanism adapted to selectively change the spacing of the second pair of components, and a second scale indicating the spacing of the second pair of components, the indicated spacing being correlated to the product dimension in a second manner different than the first manner;

the scales being adapted to the manners of correlation such that differences in the spacing of the first pair of components and the spacing of the second pair of components for the product dimension result in the indicated spacing from the first and second scales being substantially the same.

2. The film wrapping system of claim 1 wherein the first scale is a full-scale representation of the first spacing and the second scale is not a full scale representation of the second spacing.

3. The film wrapping system of claim 1 wherein at least one of the first and second scales is analog.

4. The film wrapping system of claim 1 wherein at least one of the first and second scales is digital.

5. The film wrapping system of claim 1 wherein the product dimension is one of a height and a width of the product.

6. The film wrapping system of claim 1 wherein the first and second components are each film inverter rods adapted to invert and re-direct a two-ply film trained around the film inverter rods.

7. The film wrapping system of claim 1 wherein the first and second adjustment mechanisms are manually operable.

8. The film wrapping system of claim 1 wherein a unit dimension on the first scale does not equal a unit dimension on the second scale.

9. The film wrapping system of claim 1 wherein units of dimension on the first and second scales are generally equal.

10. The film wrapping system of claim 1 further comprising:

a feed conveyor adapted to delivery a series of products in a feed direction;

a film delivery unit adapted to dispense a supply of film having first and second plies joined together along a longitudinal fold line, each of the first and second plies having a free edge spaced from and generally parallel to the longitudinal fold line and a first face opposite from a second face, the respective first faces of the plies being juxtaposed to one another at the film delivery unit;

a wrapping station adapted to receive the film from the film delivery unit and to wrap each of the products delivered thereto by the feed conveyor;

wherein the film delivery unit is adapted to deliver the film to the wrapping station in a direction generally perpendicular to the feed direction;

a side seal mechanism located downstream in the feed direction from the wrapping station to join the first and second plies together proximate the respective free edges of the plies;

an end seal mechanism located downstream in the feed direction from the side seal mechanism to join the first and second plies together in a direction generally perpendicular to the feed direction; and a heat shrink tunnel located downstream in the feed direction from the wrapping station to heat the film and thereby shrink it around the product.

11. A film wrapping system for wrapping a plurality of products having different dimensions in film, the system comprising:

a first and a second component spaced from one another;

a first adjustment mechanism adapted to selectively change a first spacing between the first and second components;

a first display indicating the first spacing between the first and second components;

a third and a fourth component spaced from one another;

a second adjustment mechanism adapted to selectively change a second spacing between the third and fourth components;

a second display indicating the second spacing between the third and fourth second components;

wherein the first and second displays provide substantially the same readings for differing first and second spacings.

12. The film wrapping system of claim 11 wherein the first scale is a full-scale representation of the first spacing and the second scale is not a full scale representation of the second spacing.

13. The film wrapping system of claim 11 wherein at least one of the first and second scales is analog.

14. The film wrapping system of claim 11 wherein at least one of the first and second scales is digital.

15. The film wrapping system of claim 11 wherein the product dimension is one of a height and a width of the product.

16. The film wrapping system of claim 11 wherein the first and second components are each film inverter rods adapted to invert and re-direct a two-ply film trained around the film inverter rods.

17. The film wrapping system of claim 11 wherein the first and second adjustment mechanisms are manually operable.

18. The film wrapping system of claim 11 wherein a unit dimension on the first scale does not equal a unit dimension on the second scale.

19. The film wrapping system of claim 11 wherein units of dimension on the first and second scales are generally equal.

20. The film wrapping system of claim 11 further comprising:

a feed conveyor adapted to delivery a series of products in a feed direction;

a film delivery unit adapted to dispense a supply of film having first and second plies joined together along a longitudinal fold line, each of the first and second plies having a free edge spaced from and generally parallel to the longitudinal fold line and a first face opposite from a second face, the respective first faces of the plies being juxtaposed to one another at the film delivery unit;

a wrapping station adapted to receive the film from the film delivery unit and to wrap each of the products delivered thereto by the feed conveyor;

wherein the film delivery unit is adapted to deliver the film to the wrapping station in a direction generally perpendicular to the feed direction;

a side seal mechanism located downstream in the feed direction from the wrapping station to join the first and second plies together proximate the respective free edges of the plies;

an end seal mechanism located downstream in the feed direction from the side seal mechanism to join the first and second plies together in a direction generally perpendicular to the feed direction; and a heat shrink tunnel located downstream in the feed direction from the wrapping station to heat the film and thereby shrink it around the product.

21. The film wrapping system of claim 11 wherein the first and second spacings are different but the displayed spacings on the first and second scales are substantially the same.

* * * * *

UNITED STATES PATENT AND TRADEMARK OFFICE

CERTIFICATE OF CORRECTION

PATENT NO. : 7,143,569 B2
APPLICATION NO. : 10/970538
DATED : December 5, 2006
INVENTOR(S) : Jean-Louis Limousin It is certified that error appears in the above-identified patent and that said Letters Patent is hereby corrected as shown below:

Col. 9, ln. 62, "adapted to delivery a" should read --adapted to deliver a--.

Col. 10, ln. 65, "adapted to delivery a" should read --adapted to deliver a--.

Signed and Sealed this

Twenty-fourth Day of April, 2007

JON W. DUDAS
*Director of the United States Patent and Trademark Office*